US005766112A

United States Patent [19]

Chuan

[11] Patent Number: 5,766,112

[45] Date of Patent: Jun. 16, 1998

[54] PORTABLE WRISTS EXERCISING APPARATUS

[76] Inventor: Huang Ching Chuan, P.O. Box 55-175, Taichung, Taiwan

[21] Appl. No.: 854,404

[22] Filed: May 12, 1997

[51] Int. Cl.[6] ..... A63B 5/00

[52] U.S. Cl. ..... 482/44; 482/121

[58] Field of Search ..... 482/127, 41–45, 482/121

[56] References Cited

U.S. PATENT DOCUMENTS

| | | | |
|---|---|---|---|
| 4,805,899 | 2/1989 | Rochlk | 482/45 |
| 5,046,727 | 9/1991 | Wilkinson et al. | 482/45 |
| 5,263,908 | 11/1993 | Chen | 482/127 |
| 5,643,158 | 7/1997 | Clementi | 482/45 |

*Primary Examiner*—Jerome W. Donnelly

[57] ABSTRACT

A portable wrist exercising apparatus is provided. The apparatus includes a hollow circular body composed of a pair of hollow circular members and a first and second arcuate handles. The hollow circular members are rotatably engaged together and biased by a torque spring so that they can he alternately rotatable against the torque or the spring. The first arcuate handle is slidably secured to the circular body and biased by a pair of compression springs so that the handle can be drawn off the body and restored back by the compression springs. An annulus disposed on the central periphery of the body including a plurality of domes thereon. So that the apparatus is not only adaptable to exercise the wrists and arms of the user, but also be used for massage purpose.

5 Claims, 6 Drawing Sheets

PORTABLE WRISTS EXERCISING APPARATUS

BACKGROUND OF THE INVENTION

1. Field of the Invention

The present invention relates to exercising devices and more particularly to a portable wrist exercising apparatus which provides proper torque and compression force against a manual rotation and drawing of the apparatus by the users to exercise their wrists and arms.

2. Description of the Prior Art

In an industrial society, people are busy with their own works or besinesses. They have scarcely leisure to exercise themselves at an exercising site. Therefore, a lot of exercising apparatus of different forms are provided in the market for facilitating people exercising at home or in their offices at intermission.

This portable wrist exercising apparatus provides more convenience to the people who can carry it with them and exercise at any suitable time and place in order to satisfy their personal healthy requirement.

SUMMARY OF THE PRESENT INVENTION

The main object of the present invention is to provide a portable wrist exercising apparatus which provides either torque or compression force against a manual rotation or drawing of the apparatus by the users for exercising their wrists and arms.

Accordingly, the portable wrist exercising apparatus of the present invention comprises generally a pair of first and second hollow circular means of identical structure, each including a tubular axle rotatably engaged with each other by bolt, a first and a second arcuate handle respectively secured to the outer surface of the first and second hollow circular means, a torque spring wrapped on the tubular axle and biased therebetween so as to provide proper torque against the alternate rotation of the circular means by the user, a pair of partially threaded rods slidably engaged between the first arcuate handle and the first hollow circular means each biasing with a compression spring so that the first arcuate handle can be slidably drawn about the rods to engage or disengage with the first hollow circular means in order that the users can also exercise their arms.

The present invention will become more fully understood by reference to the following detailed description thereof when read in conjunction with the attached drawings.

DETAILED DESCRIPTION OF THE PREFERRED EMBODIMENT(S)

Figure 1:
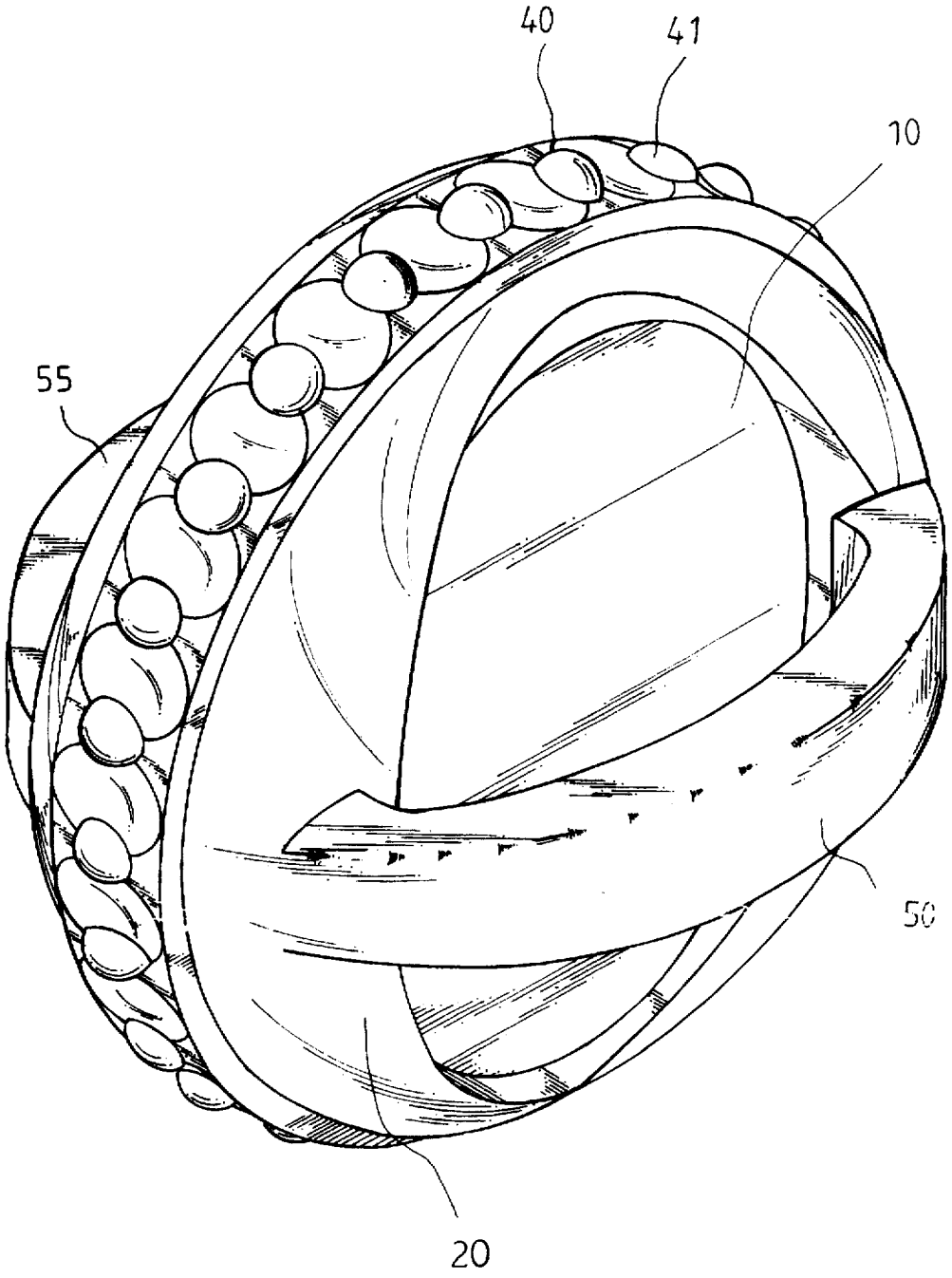
FIG. 1 is a perspective view to show the preferred embodiment of the wrist exercising apparatus of the present invention.

With reference to the drawings and originating from FIG. 1, the portable wrist exercising apparatus of the present invention comprises generally a hollow circular body 10, a pair of first and second arcuate handles 50 and 55 extended outward from two opposite sides of the body 10 which is rotatably coupled with a pair of first and second hollow circular means 20 and 30 of identical structure and an annulus 40 movably engaged therebetween.

Figure 2:
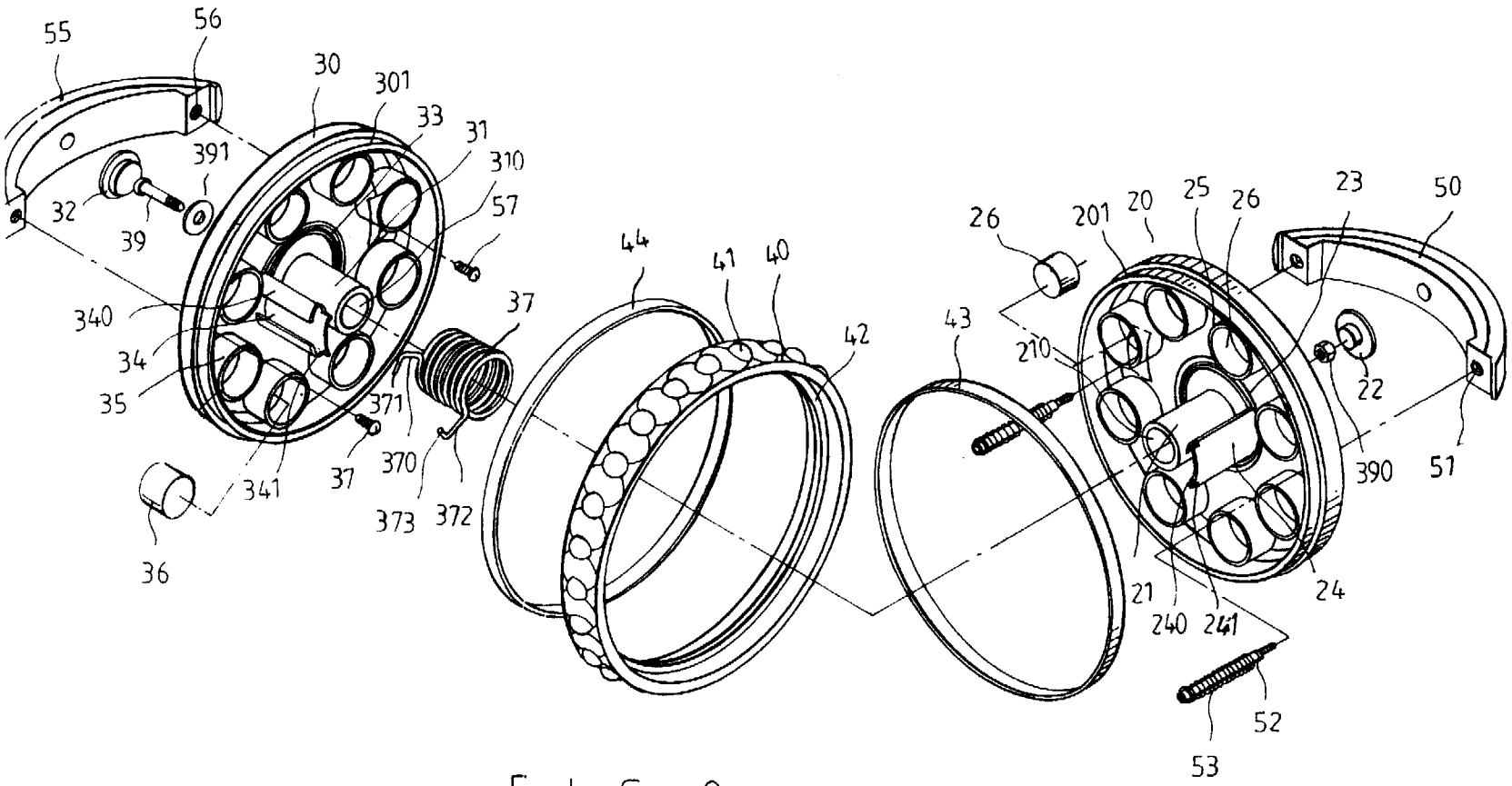
FIG. 2 is an exploded perspective view to show the elements of the preferred embodiment of the present invention.
Figure 3:
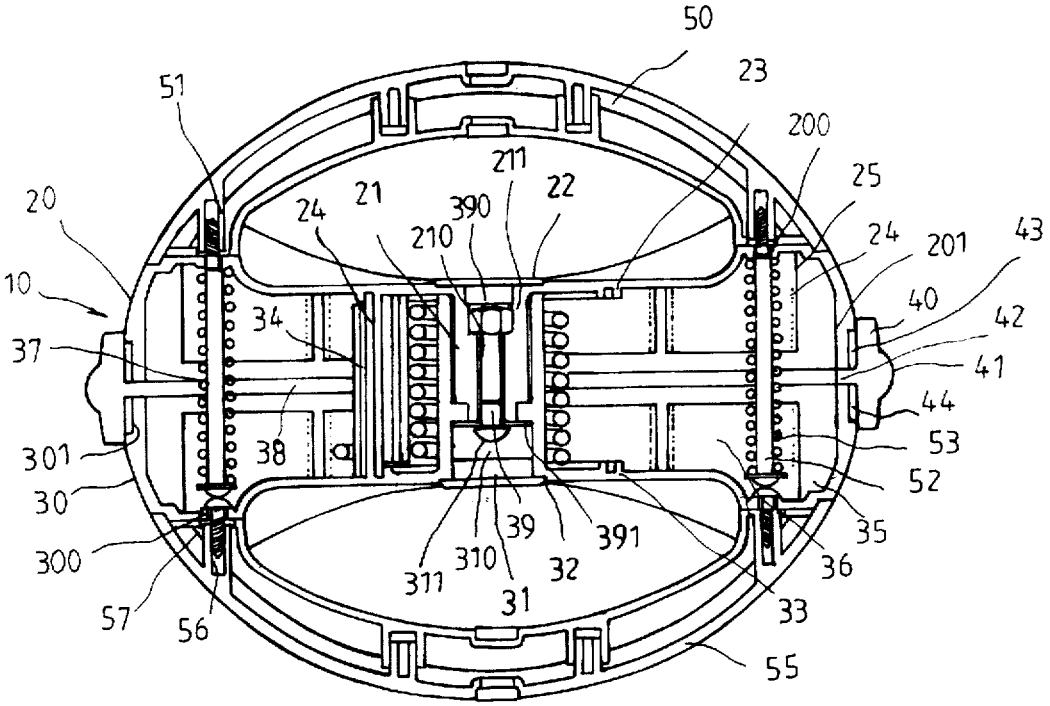
FIG. 3 is a sectional view to show the assemblage of the preferred embodiment of the present invention.

Referring to FIGS. 2 and 3, the first and second hollow circular means 20 and 30 each includes a pair of screw holes 200 and 300 for respectively securing the first and second arcuate handles 50 and 55, an annular groove 201 and 301 around an outward rim for slidably engaging with the annulus 40, a tubular axle 21 perpendicularly projected inward from a central hole in the inner surface of the first circular means 20 including a first central bore 210 in which an annular shoulder 211 is formed adjacent the free end. Correspondingly, an axial rod 31 including a second central bore 310 centrally projects from the inner surface of the second circular means 30 and is engageable within the free end of the tubular axle 21. The axial rod 31 has a small screw hole 311 centrally formed in the free end abutting the annular shoulder 211 of the tubular axle 21 (as shown in FIG. 3). A pair of plastic caps 22 and 32 insert into the outward end of the central bores 210 and 310. In the inner surface of the first and second circular means 20 and 30 and around the tubular axle 21 and the axle rod 31, there is a circular groove 23 and 33 of different diameters wherein the circular groove 23 of the first circular means 20 is larger than the circular groove 33 of the second circular means 30. A first arcuate plate 24 including a laterally reduced end 241 projects inwardly from a circumference of the circular groove 23 parallel to the tubular axle 21. The reduced end 241 is engageable with the circular groove 33. Whereas, a second arcuate plate 34 also including a laterally reduced end 341 projects inwardly from a circumference of the circular groove 33 parallel to the axle rod 31. The reduced end 341 is engageable with the circular groove 23. Further, the lateral sides of the first and second arcuate plates 24 and 34 have been bent inward to make a rib 240 and 340 of roughly L-shaped section. A torque spring 37 sleeves on the outer periphery of the tubular axle 21 including a pair of L-shaped legs 370 and 372 respectively biased on one of the lateral sides of the first and second arcuate plates 24 and 34. So that the torque spring 31 can be compressed against the alternate rotations of the first and second hollow circular means 20 and 30. The first and second hollow circular means 20 and 30 each includes a plurality of tubular means 25 and 35 of identical number symmetrical and spacedly projecting from their inner surfaces adjacent their peripheral walls each of the tubular means has a cylinder receiving space for receiving a weights 26 and 36 in order to increase the weight of the body 10 to promote the training efficiency.

The annulus 40 which is rotatably positioned on the outside of a clearance 38 between the annular grooves 201 and 301 of the first and second hollow circular means 20 and 30 as they are engaged, has a plurality of domes 41 spacedly formed around and outer periphery for massaging purpose and an annular protrusion 42 centrally formed along the inner periphery engageable within the clearance 38. A pair of annular weights 43 and 44 are rotatably disposed in the annular grooves 201 and 301 of the first and second hollow circular means 20 and 30 under the annulus 40.

Both the first and second arcuate handles 50 and 55 have an outward curve conforming with the outward arcuate shape of the first and second hollow circular means 20 and 30 so that they form an oval outer appearance as a whole after engagement. The handles 50 and 55 each have a pair of screw holes 51 and 56 which register with the screw holes 200 and 300 of the first and second circular means 20 and 30. Wherein the second arcuate handle 55 is fixedly connected with the second circular means 30 with bolts 57. However, the first arcuate handle 50 is slidably secured to the screw holes 200 of the first circular means 20 with a pair of sliding rods 52 which are biased with a pair of compression springs 53 inside the first circular means 20 each has a threaded portion fastened by nuts from outside of the first arcuate handle 50. So that the handle 50 normally attaches to the first circular means 20 because of compression force of the spring 53 or is drawn outward by the users alternately to exercise their arms. Finally, the first and second hollow circular means 20 and 30 are engaged together by means of a round headed screw 39, a washer 391 and a nut 390. The screw 39 wrapped with washer 391 inserted into the central bores 210 and 310 of the axle rod 31 and tubular axle 21 and rotatably fastened by nut 390 from the outward side of the first hollow circular means 20. Therefore a complete structure of a wrist exercising apparatus of the present invention is accomplished (as shown in FIG. 3).

Referring to FIGS. 4, 5, 6 and 7, in operation, first grip the arcuate handles 50 and 55 with hands and alternately twist the handles 50 and 55. The torque spring 37 will provide adequete torque force against alternative twisting activities and. This facilitates the user to exercise their wrists.

Figure 4:
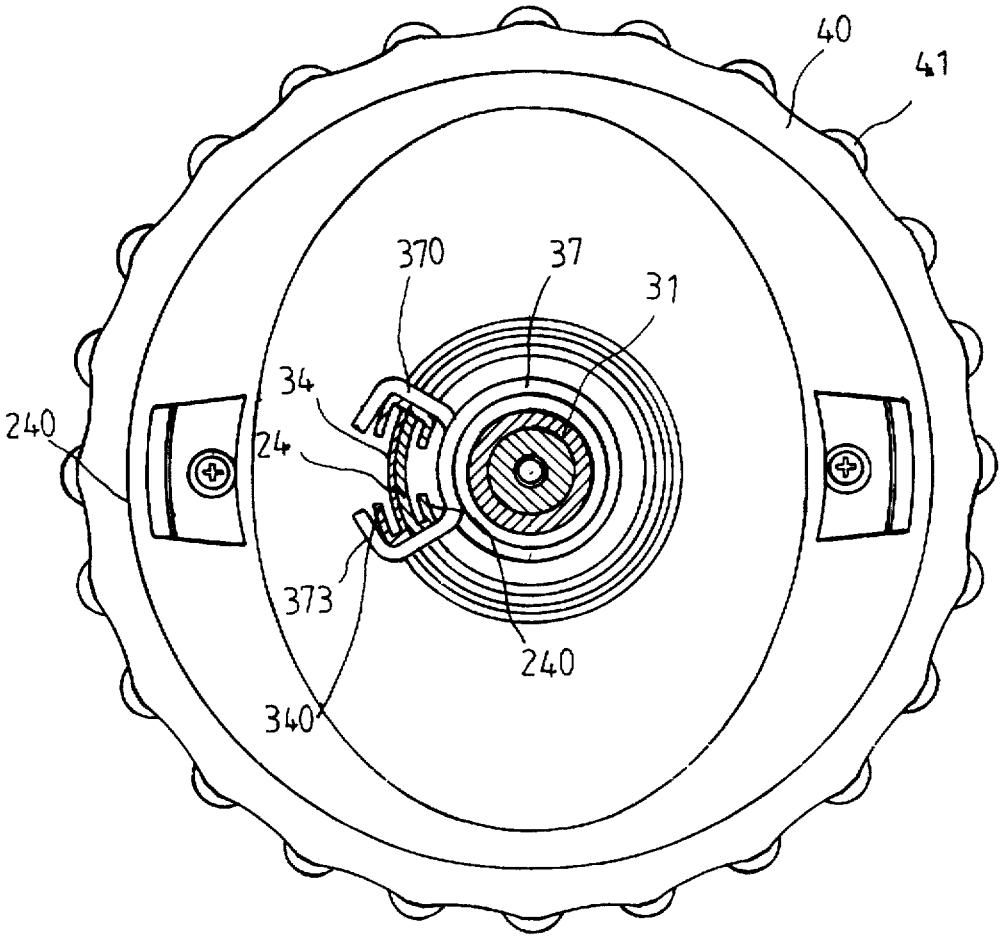
FIG. 4 is a cross-section to show the correlation between the torque spring and the arcuate plates.

FIG. 4 shows the torque spring 37 stretched outward so as to force the arcuate plates 24 and 34 superposed together and the hollow circular means 20 and 30 remain at normal position.

Figure 6:
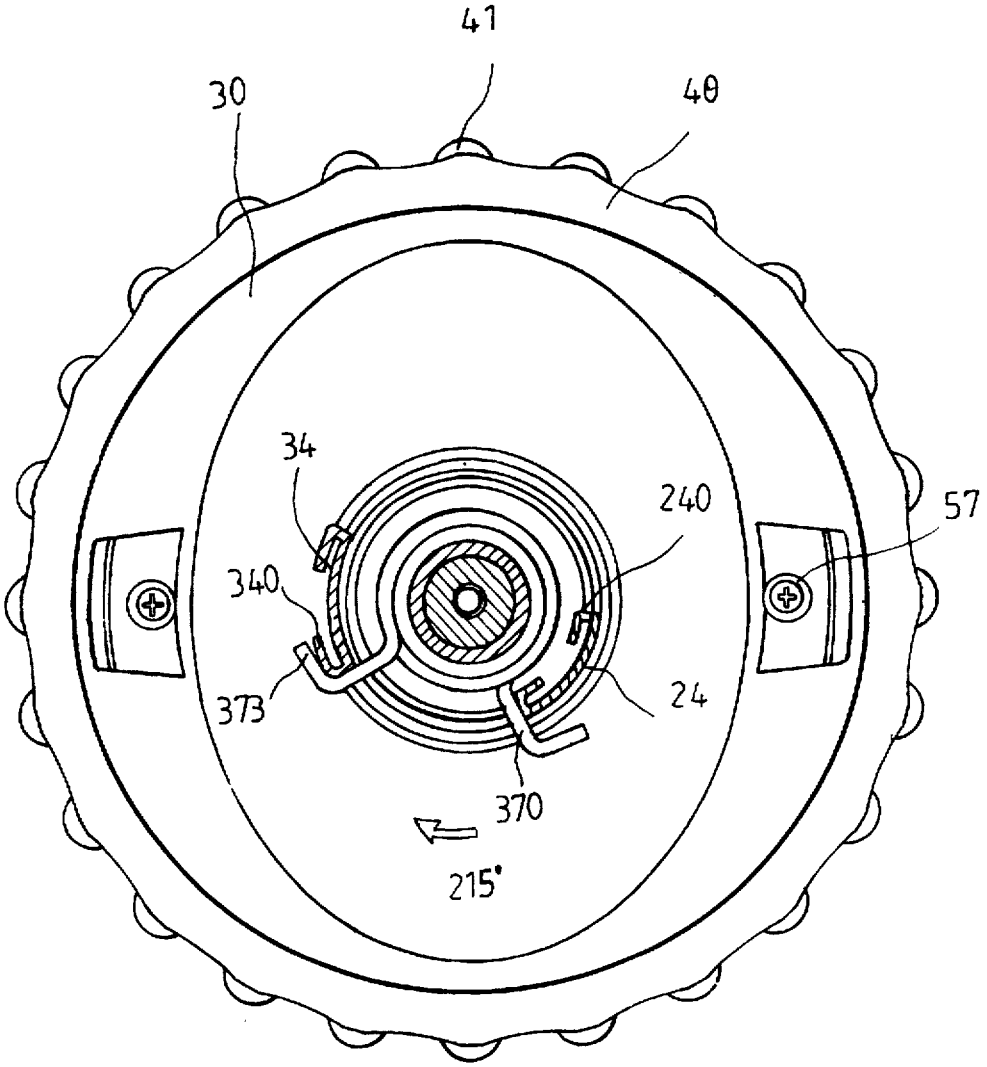
FIG. 6 is a cross-section to illustrate the rotation of the hollow circular means.

FIG. 6 shows that the circular means 20 and 30 are twisted clockwise and the arcuate plates 24 and 34 compress the torque spring 37 to reserve exerting energy for reversal action.

Figure 7:
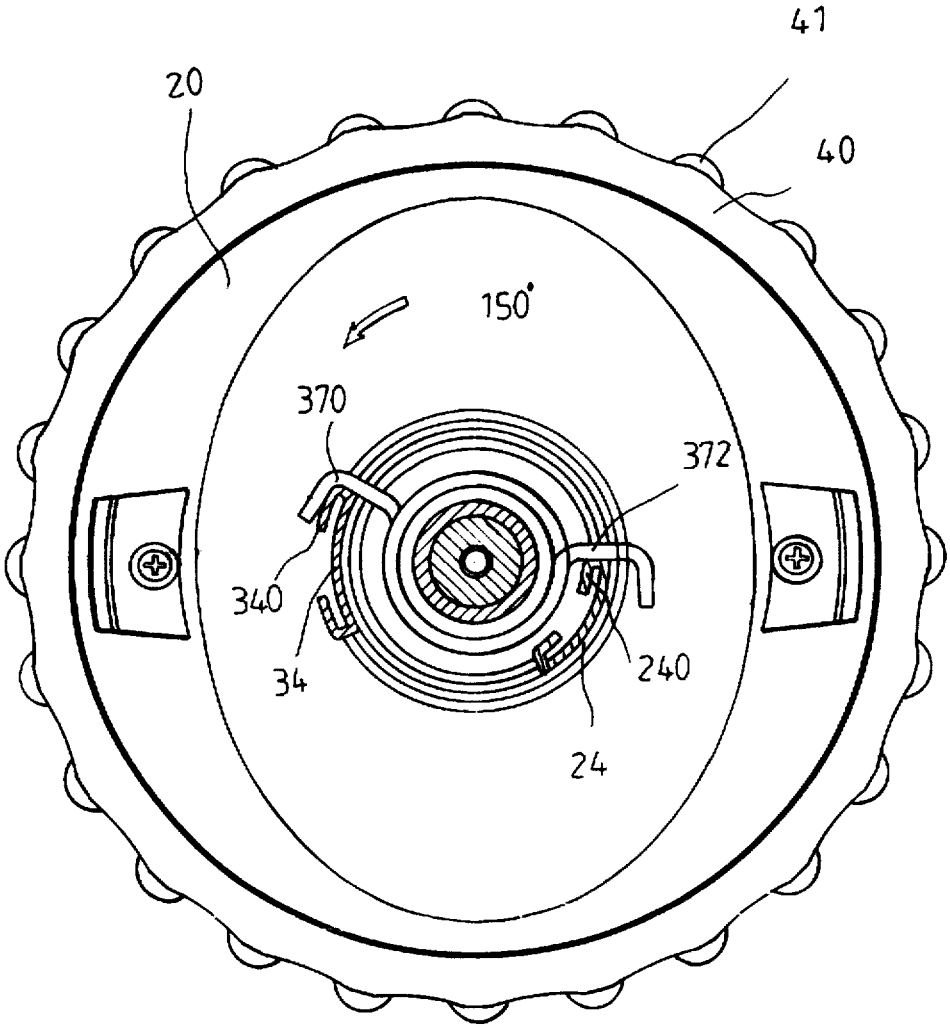
FIG. 7 is a cross-section to illustrate a reverse rotation of the hollow circular means.

FIG. 7 shows that the circular means 20 and 30 are twisted counterclockwise so that the torque spring 37 also reserves energy for exerting counter reversal action. However, the torque spring is always confined by the arcuate plates 24 and 34 and can not further stretch. So it is durable.

Figure 5:
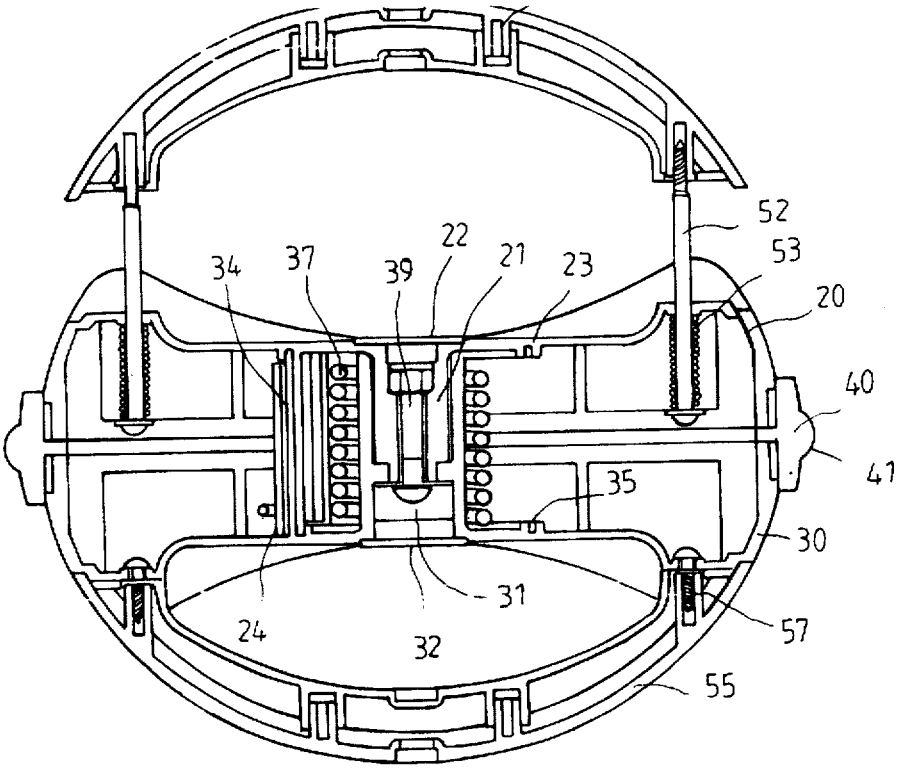
FIG. 5 is a sectional view illustrating the operation of the first arcuate handle relative to the first hollow circular means.

FIG. 5 shows that the first arcuate handle 50 is operable. The users can draw the handle 50 outward together with the sliding rods 52 which the springs 53 are compressed to reserve energy for restoring the handle 50 back to normal position. This alternate movement facilitates the users to exercise their arms.

Referring to FIGS. 1 and 2 again, it show that the domes 41 on the annulus 40 can be adapted to massage a user's body for medical purpose.

Since this wrist exercising apparatus can be portable and has multiple functions, it provides greater conveniences to the users than other exercising devices.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A portable apparatus for exercising wrists and arms comprising:

a hollow circular body said body including a first and a second hollow circular means of identical form and an annulus rotatably attached to an outer periphery thereof formed between the first and second hollow circular means;

said first and second hollow circular means each including a pair of screw holes for allowing respective attachment of a pair of first and second arcuate handles which have arcuate outer surfaces which conform with the outer arcuate shape of the first, and second hollow circular means each circular means having, an annular groove around an outer rim engageable with the annulus and a pair of annular weights, when the hollow circular means are assembled together, a plurality of tubular means perpendicularly projecting from inner surfaces of said circular means and spaced apart adjacent the rim thereof each having a receiving space for receiving a cylindrical weight, a tubular axle perpendicularly extended from a first central hole of the first hollow circular means including a first central bore in which a circular shoulder is formed at an inner peripheral wall near a free end thereof; an axle rod perpendicularly projected from a second central hole of the hollow circular means engageable with the tubular axle including a second central bore therein and a screw hole having a smaller diameter in a free end, which is inserted into said tubular axle and abuts against the circular shoulder and is rotatably secured by a screw and a nut; a first circular groove formed in an inner surface of the first hollow circular means around the tubular axle, a second circular groove of a diameter less than the first circular groove formed in an inner surface of the second hollow circular means around the axle rod, a first arcuate plate extending from the first circular groove parallel to the tubular axis having a first end engageable within the second circular groove; a second arcuate plate extended from the second circular groove parallel to the axle rod having a second end engageable within the first circular groove, said first and second arcuate plates each including a pair of lateral ribs having an cross section, and a torsional spring portioned over the tubular axle having a pair of L-shaped legs at two ends for respectively biasing with one of the lateral sides of the first and second arcuate plates.

2. An apparatus as recited in claim 1, wherein said first arcuate handle is slidably secured to the pair of screw holes of said first hollow circular means by a pair of sliding rods and biased by a pair of compression springs inside the first hollow circular means.

3. An apparatus as recited in claim 1, wherein said second arcuate handle is fixedly secured to the second hollow circular means through the pair of screw holes by means of screws.

4. An apparatus as recited in claim 1, wherein said annulus includes a plurality of domes centrally formed and spaced apart around an outer periphery thereof.

5. An apparatus as recited in claim 1 further having a pair of caps respectively covering an outward end of the first and second central bores of the first and second hollow circular means.

* * * * *